US008961156B2

(12) United States Patent
Katase

(10) Patent No.: US 8,961,156 B2
(45) Date of Patent: Feb. 24, 2015

(54) FLUID CONVEYING DEVICE AND DRIVING METHOD FOR FLUID CONVEYING DEVICE

(75) Inventor: Makoto Katase, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/315,253

(22) Filed: Dec. 8, 2011

(65) Prior Publication Data

US 2012/0148429 A1 Jun. 14, 2012

(30) Foreign Application Priority Data

Dec. 9, 2010 (JP) ..... 2010-274319

(51) Int. Cl.
*F04B 43/12* (2006.01)
*F04B 43/08* (2006.01)

(52) U.S. Cl.
CPC ..... *F04B 43/082* (2013.01); *F04B 43/12* (2013.01)
USPC ..... 417/477.3; 417/474; 417/478

(58) Field of Classification Search
USPC ..... 417/477.3, 478, 479, 474–477.14
See application file for complete search history.

(56) References Cited

U.S. PATENT DOCUMENTS 4,556,367 A 12/1985 Schmid
4,643,649 A 2/1987 Schmid
7,238,010 B2 * 7/2007 Hershberger et al. ..... 417/477.2
7,338,260 B2 3/2008 Brundle et al.
7,632,079 B2 * 12/2009 Hershberger et al. ..... 417/477.2
2004/0116862 A1 * 6/2004 Ray ..... 604/151
2010/0047099 A1 * 2/2010 Miyazaki et al. ..... 417/477.6
2010/0080720 A1 * 4/2010 Miyazaki et al. ..... 417/477.6
2010/0121306 A1 * 5/2010 Yodfat et al. ..... 604/500
2010/0143168 A1 * 6/2010 Miyazaki et al. ..... 417/412
2011/0034900 A1 * 2/2011 Yodfat et al. ..... 604/500
2012/0027624 A1 * 2/2012 Miyazaki et al. ..... 417/53

FOREIGN PATENT DOCUMENTS

JP 61-234284 10/1986
JP 01-249967 10/1989
JP 2004-092537 3/2004
JP 2007-529984 10/2007

* cited by examiner

*Primary Examiner* — Christopher Bobish
(74) *Attorney, Agent, or Firm* — Workman Nydegger

(57) ABSTRACT

A fluid conveying device includes: a tube; a cam having protrusions; fingers arranged along the tube between the tube and the cam; a driving rotor which rotates the cam to sequentially push the fingers by the protrusions in a flowing direction of a fluid, repeatedly pressuring and opening of the tube, driving the cam; a detection unit which detects a rotating position of the cam; a control unit which calculates a cam rotation angle along a cumulative ejection volume, using a first approximation formula for an ejection area H where the cumulative ejection volume increases substantially in proportion to the rotation angle of the cam and a second approximation formula for a constant area J where the cumulative ejection volume little increases or decreases even if the cam rotates, driving the driving rotor until a rotating position of the cam corresponding to a designated cumulative ejection volume is reached.

6 Claims, 7 Drawing Sheets

FLUID CONVEYING DEVICE AND DRIVING METHOD FOR FLUID CONVEYING DEVICE

BACKGROUND

1. Technical Field

The present invention relates to a fluid conveying device which ejects a small volume of fluid at a low speed, and a driving method for this fluid conveying device.

2. Related Art

A peristaltic pump is traditionally known as a device for conveying a liquid at a low speed. In the peristaltic pump, plural rollers are arranged on the same circumference on a rotor, and a tube is arranged to surround the outer circumference of the rotor. As the rotor is rotated, the tube is squeezed in a liquid flowing direction by the plural rollers. The squeezing position is moved gradually, thus ejecting the liquid (for example, see JP-A-2004-92537).

In the case of ejecting a minuscule volume of fluid, the rotor in the peristaltic pump is rotated by being driven and stopped intermittently. Therefore, a pulsating current unique to the peristaltic pump is generated and the ejection volume becomes irregular. Thus, according to JP-A-2004-92537, the ejection volume at each of intermittent driven and stop positions of the rotor is measured and stored in advance, then the sum of the ejection volumes corresponding to the rotation angles of the rotor is calculated, and the rotation angle of the rotor is controlled according to a required total ejection volume.

However, the peristaltic pump has such a characteristic that the ejection volume changes each at rotation angle of the rotor in the process of liquid flowing. Therefore, it is necessary to finely divide the rotation angle of the rotor, measure and store the ejection volume at each of the divided angles, and calculate the sum of the ejection volumes at each angle every time the rotation of the rotor proceeds. Therefore, there is a problem that a rotor rotation angle control unit, including a CPU which is charge of the calculation and a memory for storing and rewriting the rotation angle of the rotor and the result of calculating the ejection volume, bears a heavy load.

JP-A-2004-92537 also discloses that data of the total ejection volume per turn of the rotor is stored in a memory in advance so that the rotation angle of the rotor is found. However, since the ejection volume fluctuates at each rotation angle of the rotor during one turn of the rotor, there is a problem that an accurate total ejection volume is difficult to grasp.

SUMMARY

An advantage of some aspects of the invention is to solve at least a part of the problems described above, and the invention can be implemented in the following forms or application examples.

Application Example 1

This application example is directed to a fluid conveying device which ejects a fluid. The device includes: an elastic tube; a cam having n (n being an integer equal to or greater than 2) protrusions; plural pressing shafts arranged along the tube between the tube and the cam; a driving unit which rotates the cam to sequentially push the plural pressing shafts by the protrusions in a flowing direction of the fluid, and thus repeats pressurized closure and opening of the tube; a detection unit which detects a rotating position of the cam; and a control unit which calculates a cam rotation angle in relation to a cumulative ejection volume, using a first approximation formula that expresses an ejection area where the cumulative ejection volume increases in proportion to the rotation angle of the cam and a second approximation formula that expresses a constant area where the cumulative ejection volume does not increase or decrease even if the cam rotates, and which drives the driving unit until the detection unit detects a rotating position of the cam corresponding to a designated cumulative ejection volume.

According to this application example, the cam rotation angle in relation to the cumulative ejection volume is calculated using the first approximation formula that expresses the ejection area where the cumulative ejection volume increases in proportion to the rotation angle of the cam and the second approximation formula that expresses the constant area where the cumulative ejection volume does not increase or decrease even if the cam rotates, and the cam is rotated until the designated cumulative ejection volume is reached. Therefore, the configuration of the control unit can be simplified and the load on the control unit can be reduced in the form of a reduced number of calculations or the like, compared with the system where the rotation angle of the rotor is finely divided, the ejection volume at each divided angle is measured and stored and the sum of the ejection volumes at each angle is calculated every time the rotation of the rotor proceeds, as in the related art. Consequently, there is an advantage that the current consumed can be reduced. Here, the phrase "in proportion to" does not necessarily mean being perfectly in proportion and also refers to cases of being substantially in proportion. The phrase "does not increase or decrease" refers to cases where the volume does not increase or decrease in terms of the constant area as a whole though the volume may increase or decrease partly, and cases where the volume increases or decreases only by an insignificant amount that can be ignored, as well as cases where the volume does not increase or decrease at all.

Moreover, by using the approximation formulae, it is possible to eliminate the influence of fluctuations in the ejection volume during the rotation of the cam or per turn of the cam and hence grasp a more accurate total ejection volume.

Application Example 2

In the fluid conveying device according to the above application example, it is preferable to make the rotation speed in the constant area higher than the rotation speed of the cam in the ejection area.

As the cam rotation speed is thus made higher in the constant area where the fluid is not ejected, the cumulative ejection volume in relation to the cam rotation angle can be expressed substantially by a straight line, and the fluid can be ejected continuously and at a constant ejection speed in an ejection designated time.

Application Example 3

In the fluid conveying device according to the above application example, it is preferable to create a reference line expressing a relation between the rotation angle of the cam and the cumulative ejection volume of the fluid, define the cumulative ejection volume ejected during 1/n turns of the cam as one ejection unit, calculate a number of ejection units based on the reference line, and calculate the rotation angle of the cam in relation to a cumulative ejection volume corresponding to a difference between the designated cumulative ejection volume and a cumulative ejection volume equivalent to the number of ejection units, using the first approximation formula and the second approximation formula.

As described above, as the cam rotation speed is made higher in the constant area where the fluid is not ejected, the cumulative ejection volume in relation to the cam rotation angle can be expressed substantially by a straight line. As this straight line is used as a reference line and the calculation uses the reference line and the approximation formulae, the rotation angle of the cam in relation to the designated cumulative ejection volume can be found easily.

Application Example 4

In the fluid conveying device according to the above application example, it is preferable that the first approximation formula performs approximation using a monotone increasing function by which the rotation angle of the cam is defined from the cumulative ejection volume.

Thus, the relation between the cumulative ejection volume and the cam rotation angle is not limited to a straight line in the ejection area, and even a quadratic curve or parabola can be used as the first approximation formula.

Application Example 5

A driving method for a fluid conveying device according to this application example is a driving method for a fluid conveying device which ejects a fluid. The method includes: rotating a cam having n (n being an integer equal to or greater than 2) protrusions; stopping the rotation of the cam when a rotation angle of the cam is detected; initializing a cumulative ejection volume and the rotation angle of the cam; calculating a rotation angle of the cam corresponding to a designated cumulative ejection volume, using an approximation formula that expresses a relation between the cumulative ejection volume and the rotation angle of the cam; starting fluid ejection by rotating the cam to sequentially push plural pressing shafts in a flowing direction of the fluid by the protrusions and thus repeating pressurized closure and opening of an elastic tube; and detecting the rotation angle of the cam, and stopping the rotation of the cam when the rotation angle corresponding to the designated cumulative ejection volume is reached.

According to this application example, the cam rotation angle in relation to the designated cumulative ejection volume can be found easily using the approximation formula. As the cam is rotated until that cam rotation angle is reached, an accurate total ejection volume (designated cumulative ejection volume) can be secured and managed. Thus, this technique is suitable for a medical fluid administering device for medical purposes which ejects a minuscule volume of liquid at a low speed or for a driving method for a liquid separation device of various analysis devices.

BRIEF DESCRIPTION OF THE DRAWINGS

The invention will be described with reference to the accompanying drawings, wherein like numbers refer to like elements.

DESCRIPTION OF EXEMPLARY EMBODIMENTS

Hereinafter, an embodiment of the invention will be described with reference to the drawings. The invention can be applied to a broad range of applications where a minuscule volume of fluid is ejected at a low speed. However, in the following embodiment, an example of a fluid conveying device used to inject a medical fluid into a living body and a driving method for this fluid conveying device will be described. Thus, the fluid used in this case is a liquid such as a medical fluid.

The drawings used in the following description are schematic views in which the vertical and horizontal scales of members or parts are different from reality, for convenience of illustration.

Fluid Conveying Device

Figure 1:
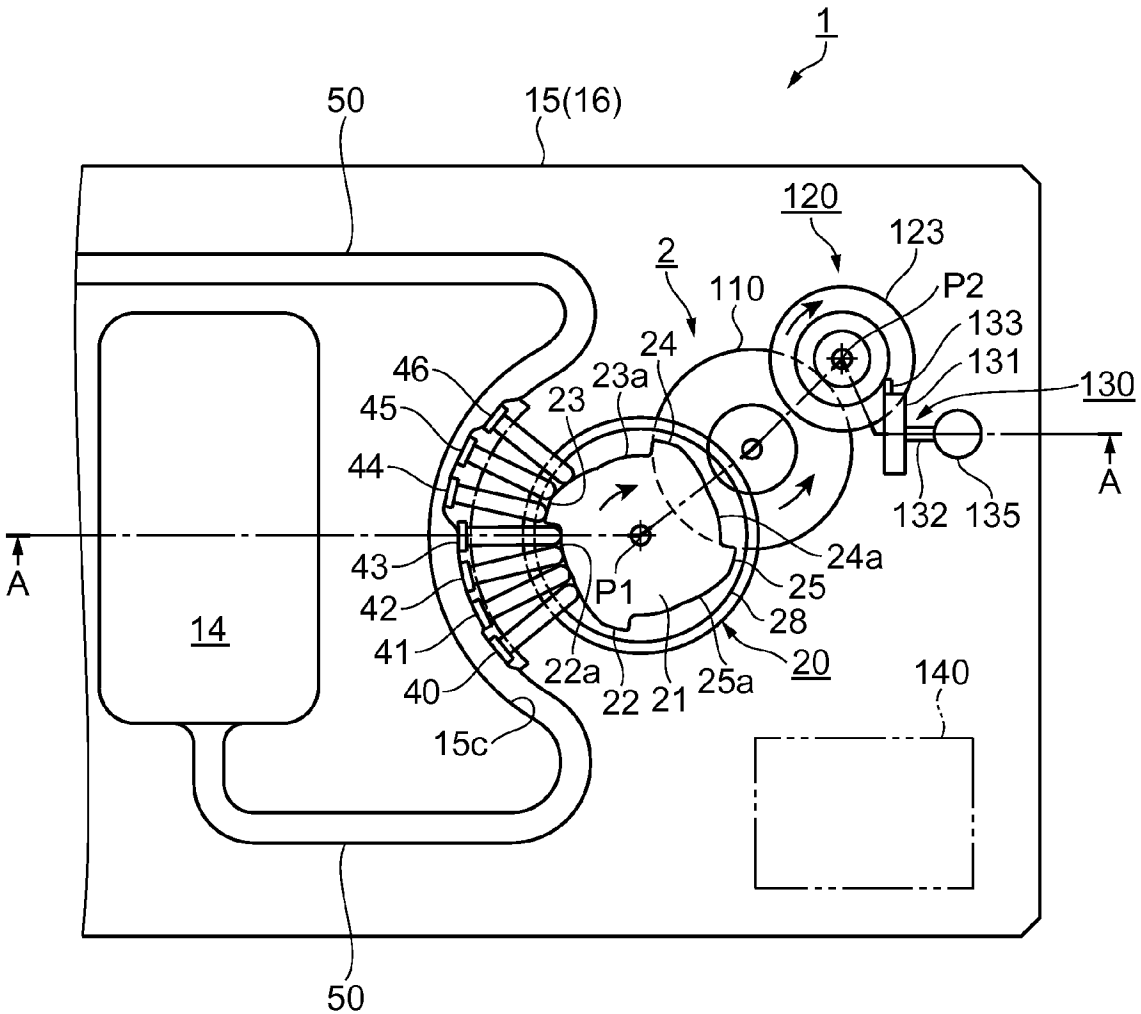
FIG. 1 is a plan view showing a schematic configuration of a fluid conveying device.
Figure 2:
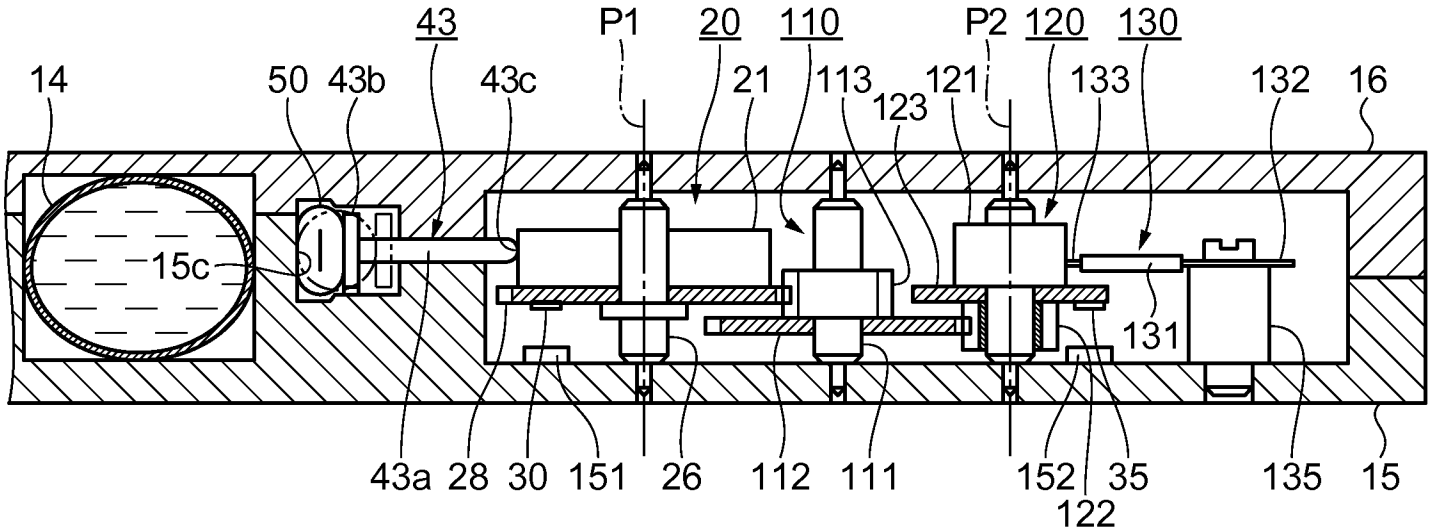
FIG. 2 is a partial sectional view showing an A-A cross section in FIG. 1.

FIG. 1 is a plan view showing a schematic configuration of a fluid conveying device. FIG. 2 is a partial sectional view showing an A-A cross section in FIG. 1. In FIG. 1 and FIG. 2, a fluid conveying device 1 includes a reservoir 14 housing a liquid, an elastic tube 50 continuing to the reservoir 14, fingers 40 to 46 as plural pressing shafts which pressurize and close the tube 50, a cam 20 pushing the fingers 40 to 46 toward the tube 50, a driving rotor 120 as a driving unit for the cam 20, a deceleration transmission mechanism 2 connecting the cam 20 and the driving rotor 120, and a first frame 15 and a second frame 16 holding these parts.

The tube 50 is shaped partly in a circular arc shape by a circular arc-shaped tube guide wall 15*c* formed on the first frame 15. One end continues to the reservoir 14 and the other end is extended outside. The center of the circular arc of the tube guide wall 15*c* coincides with a center of rotation P1 of the cam 20. The fingers 40 to 46 are arranged between the tube 50 and the cam 20. The fingers 40 to 46 are arranged radially at equal angles from the direction of the center of rotation P1 of the cam 20.

The fingers 40 to 46 have the same shape. The finger 43 is described as an example with reference to FIG. 2. The finger 43 includes a bar-like shaft part 43*a*, a tube pressing part 43*b* formed in a flange-like shape at one end of the shaft part 43*a*, and a cam abutting part 43*c* formed in a hemispherical shape at the other end. In this example, the finger 43 is made of a metallic material or a resin material with high rigidity. The cross section of the finger 43 perpendicular to its axial direction is circular or quadrilateral.

As shown in FIG. 2, the cam 20 includes a cam shaft 26, and a cam gear 28 and cam body 21 which are retained on the camshaft 26. The cam 20 is axially supported by the first frame 15 and the second frame 16. As shown in FIG. 1, the cam body 21 has protrusions 22, 23, 24 and 25 at four positions on an outer circumference. The protrusions 22, 23, 24 and 25 have the same circumferential pitch and the same shape. The protrusions 22 to 25 are pushing parts which sequentially push the fingers 40 to 46 from upstream to downstream. Therefore, the protrusions are hereinafter referred to as finger pushing parts. The side near the reservoir 14 is referred to as upstream and the far side is referred to as downstream.

On the cam body 21, slope parts 22*a*, 23*a*, 24*a* and 25*a* are formed which gently continue to the finger pushing parts 22, 23, 24 and 25, respectively, from areas for releasing the fingers 40 to 46 (that is, opening the tube 50).

The case of four protrusions is illustrated here, but the number of protrusions may be n (n being an integer equal to or greater than 2) and is not limited to four.

Subsequently, the configuration of the deceleration transmission mechanism 2 will be described with reference to FIG. 1 and FIG. 2. The deceleration transmission mechanism 2 includes the cam gear 28, a transmission wheel 110, and a rotor pinion 122 retained on a rotor shaft 121. The transmission wheel 110 includes a transmission wheel shaft 111 with a pinion 113 formed thereon, and a transmission gear 112. The driving rotor 120 includes the rotor shaft 121, the rotor pinion 122, and a detection plate 123 retained on the rotor shaft 121. The transmission wheel 110 and the driving rotor 120 are axially supported together with the cam 20 by the first frame 15 and the second frame 16. Here, the rotation of the driving rotor 120 is transmitted to the cam 20 at a predetermined deceleration ratio by the above deceleration transmission mechanism 2. In the description of this example, the deceleration ratio is 40. That is, one turn of the driving rotor is equivalent to 1/40 turns of the cam 20. The center of rotation of the driving rotor 120 is P2.

The driving source for rotating the driving rotor 120 is an oscillating unit 130. The oscillating unit 130 includes a piezoelectric element 131, an arm part 132, and a protruding part 133 abutting on the lateral side of the rotor shaft 121. The oscillating unit 130 has the arm part 132 screwed and fixed with a screw to a fixed shaft 135 provided upright on the first frame 15. The configuration of and the driving method for the oscillating unit 130 will not be described here since the configuration of and the driving method for a known oscillating unit can be applied. The driving of the oscillating unit 130 is controlled by a driver 141 (see FIG. 3) included in a control unit 140.

A step motor can be employed as a driving unit.

Next, the configuration of the control unit 140 and a detection unit will be described with reference to FIG. 2 and FIG. 3.

Figure 3:
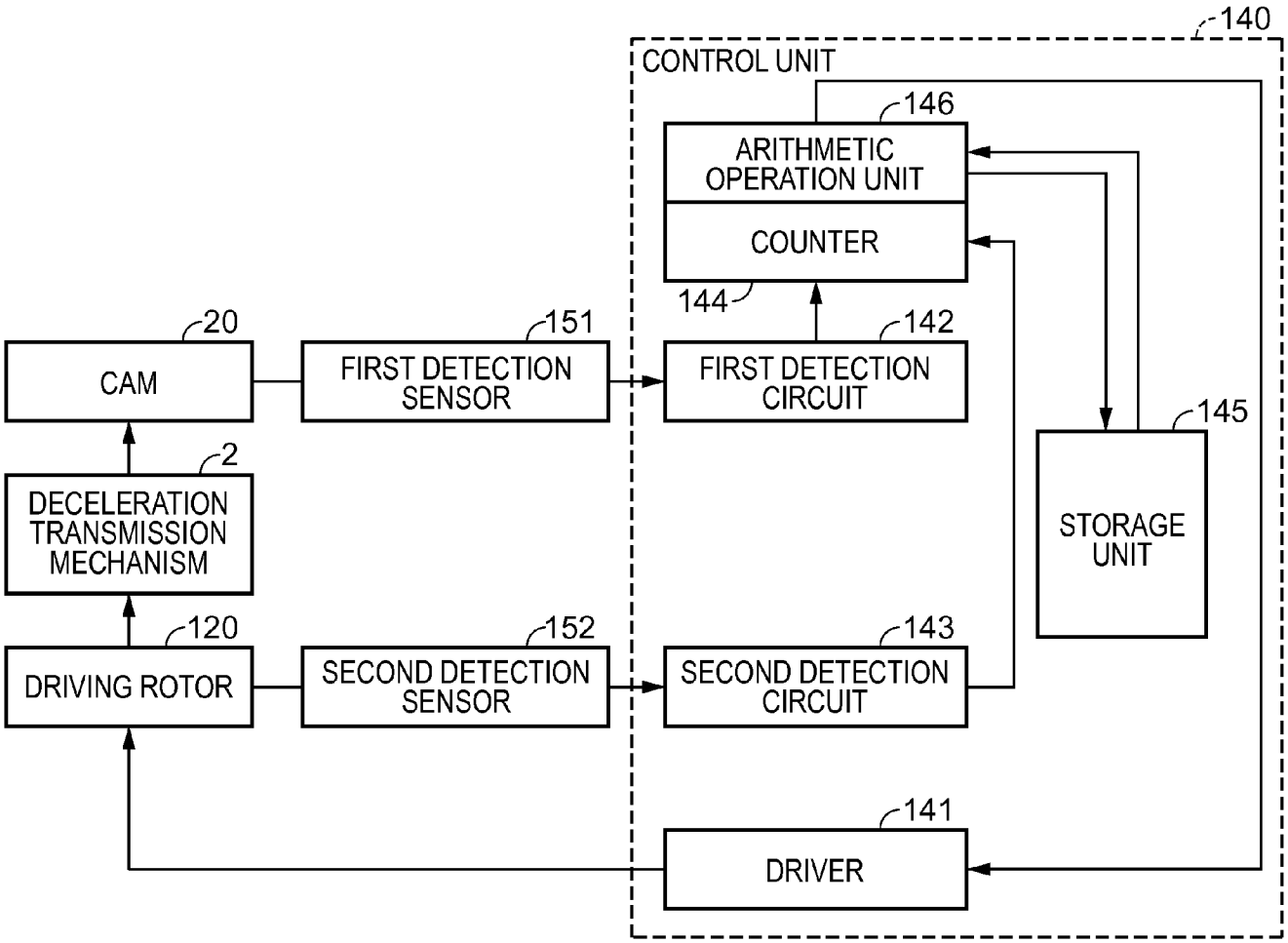
FIG. 3 is an explanatory view of configuration showing an example of a control unit and a detection unit.

FIG. 3 is an explanatory view of configuration showing an example of the control unit and the detection unit. The detection unit includes a first detection unit which detects a rotation angle (rotating position) of the cam 20, and a second detection unit which detects a rotation angle (rotating position) of the driving rotor.

As shown in FIG. 3, the first detection unit includes a first detection sensor 151 which detects the rotating position of the cam 20, and a first detection circuit 142. The first detection sensor 151 is an optical sensor including a light emitting element and a light receiving element (neither of them shown). As shown in FIG. 2, on a surface of the cam gear 28 facing the first detection sensor 151, a first detection marker 30 indicating the rotating position is provided. The first detection marker 30 reflects light that exits the light emitting element, and the light receiving element detects this reflected light.

As shown in FIG. 3, the second detection unit includes a second detection sensor 152 which detects the rotation angle of the driving rotor 120, and a second detection circuit 143. The second detection sensor 152 is an optical sensor including a light emitting element and a light receiving element (neither of them shown). As shown in FIG. 2, on a surface of the detection plate 123 facing the second detection sensor 152, a second detection marker 35 indicating the rotating position of the driving rotor 120 is provided. The second detection marker 35 reflects light that exits the light emitting element, and the light receiving element detects this reflected light.

The first detection marker 30 and the second detection marker 35 will be described later with reference to FIG. 4 and FIG. 5. As the first detection sensor 151 and the second detection sensor 152, the reflection-type sensors are described as an example. However, transmission-type sensors may also be used, and non-contact sensors such as magnetic sensor and ultrasonic sensor, or contact sensors may also be employed.

The control unit 140 includes a counter 144 which counts the numbers of detections of the first detection marker 30 and the second detection marker 35 detected respectively by the first detection circuit 142 and the second detection circuit 143, a storage unit 145 which stores the numbers of detections of the first detection marker 30 and the second detection marker 35, an arithmetic operation unit 146 which calculates a rotation angle of the driving rotor 120 for rotating the cam 20 to a rotating position corresponding to a designated cumulative ejection volume, and the driver 141 which drives the oscillating unit 130 with a predetermined frequency and by a calculated time, as shown in FIG. 3.

Next, an exemplary configuration of the first detection marker 30 and the second detection marker 35 will be described with reference to FIG. 4 and FIG. 5.

Figure 4:
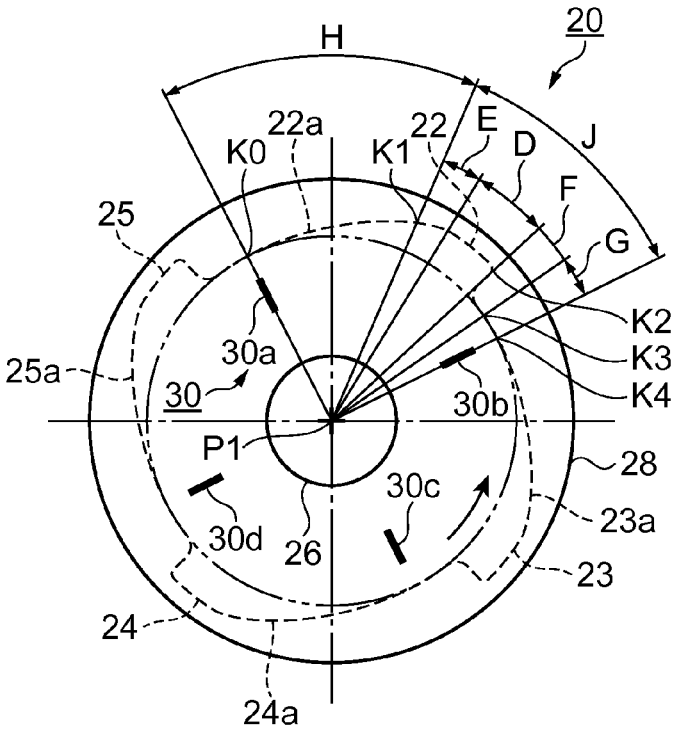
FIG. 4 is a plan view showing a first detection marker indicating a rotation reference position of a cam.

FIG. 4 is a plan view showing the first detection marker indicating a rotation reference position of the cam. FIG. 4 shows the side facing the first detection sensor 151. The first detection markers 30 include four first detection markers 30*a* to 30*d*. The first detection markers 30*a* to 30*d* are radially formed at equal distances from the center of rotation P1 and at equal angular spaces from each other on the surface of the cam gear 28. In this example, the case of division into four equal parts in the circumferential direction is illustrated. The first detection markers 30*a*, 30*b*, 30*c* and 30*d* are provided respectively at positions corresponding to the finger pushing parts 22, 23, 24 and 25. Therefore, the number of the finger pushing parts matches the number of the first detection markers 30 (the number of divisions) and the angle between the first detection markers 30 is 90 degrees.

The vertex parts of the finger pushing parts 22 to (indicated as an area D) on the cam body 21 are formed concentrically about the center of rotation P1. The area D is an area where the tube 50 is pressurized and closed by the same squeezing amount. The cam 20 rotates in the direction of arrow (counterclockwise). The moment the area D is passed, the pushing of the fingers is canceled and the pressurized and closed tube 50 is opened. An area where the tube 50 is opened before pressurized closure starts again is indicated as an area F. The pressurized closure area of the tube 50 is set to start before the vertex parts of the protrusions 22 to 25 are reached (area E) in consideration of variance. The area F is an area where the liquid that is ejected from the moment the pushing of the fingers is canceled to open the pressurized and closed tube 50 flows backward and the cumulative ejection volume decreases. An area G is a cam rotating area of up to when the same cumulative ejection volume as in the area D is reached by the pressurized closure of the tube 50 due to the rotation of the cam 20.

An area where the pressurized closure of the tube 50 is started after the pushing of the fingers is started is an ejection area H.

An area J including the area D, the area E, the area F and the area G is an ejection volume constant area where there is little increase or decrease in the cumulative ejection volume. The relation between each rotating area of the cam 20 and the cumulative ejection volume will be described later with reference to FIG. 6.

Figure 5:
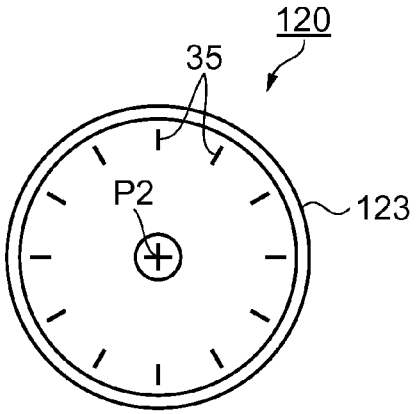
FIG. 5 is a plan view showing a second detection marker indicating a rotation angle of a driving rotor.

FIG. 5 is a plan view showing the second detection marker indicating a rotation angle of the driving rotor. The second detection markers 35 are formed radially at equal distances from the center of rotation P2 and at equal spaces from each other on the surface of the detection plate 123. In this example, the case where the second detection markers 35 are divided into twelve in the circumferential direction is illustrated. Therefore, the angle between the neighboring second detection markers 35 is 30 degrees.

Here, the deceleration ratio from the driving rotor 120 to the cam 20 is assumed to be 1/40. For one turn of the driving rotor 120, the cam 20 rotates 1/40 turns (rotates 9 degrees). Since the second detection markers 35 are divided into twelve, the rotational resolution of the driving rotor is 30 degrees. The rotational resolution of the cam 20 is 30/40=0.75 degrees.

The number of divisions of the second detection markers 35 is not limited to twelve and may be properly set according to the requirement of angular resolution of the cam 20, deceleration ratio, or angle detection resolution of the second detection sensors. It is desirable that the second detection markers 35 are divided in a number corresponding to the number of protrusions.

The position where the second detection unit is provided is not limited to the driving rotor 120. The second detection unit can be provided on one part of the deceleration transmission mechanism 2. For example, the second detection markers 35 may be formed at the position of the transmission gear 112 of the transmission wheel 110, and the second detection sensor 152 may be arranged at a position facing the second detection markers 35. In such case, since the deceleration ratio changes, the rotation speed of the cam 20, the deceleration ratio and the number of divisions of the second detection markers 35 are properly set.

The first detection markers 30 and the second detection markers 35 are made of a material that reflects light or absorbs light. Alternatively, holes penetrating the cam gear 28 and the detection plate 123 may be provided.

Next, liquid ejection will be described with reference to FIG. 1. When a driving signal is inputted to the piezoelectric element 131 from the control unit 140 (specifically, the driver 141), the protruding part 133 of the oscillating unit 130 elliptically oscillates and causes the driving rotor 120 to rotate clockwise. The rotating force of the driving rotor 120 rotates the cam 20 clockwise at the deceleration ratio of 1/40 via the deceleration transmission mechanism 2. In the state shown in FIG. 1, the protrusion 23 pushes the finger 44, thus pressurizing and closing the tube 50. The fingers 45 and 46 are on the slope part 23*a* of the cam body 21 and therefore do not pressurize and close the tube 50 completely.

The fingers 41, 42 and 43 are not on the slope part 22*a* of the cam body 21 yet. Therefore, the tube 50 is open. The finger 40 starts to get on the slope part 22*a* and the tube 50 is still open. There is a fluid in the area of the tube 50 that is pressurized and closed.

As the cam 20 is further rotated clockwise, the fingers 40 to 46 are pushed sequentially from upstream to downstream in the rotating direction of the cam 20. Thus, pressurized closure, opening, and pressurized closure of the tube 50 are repeated. The liquid is thus conveyed and ejected in the rotating direction of the cam 20 by the peristaltic movement of the fingers 40 to 46. The plural fingers 40 to 46 are configured so that at least one, preferably two of the fingers 40 to 46 constantly pressurize and close the tube 50.

Next, the relation between the rotation angle of the cam 20 and the cumulative ejection volume will be described.

Figure 6:
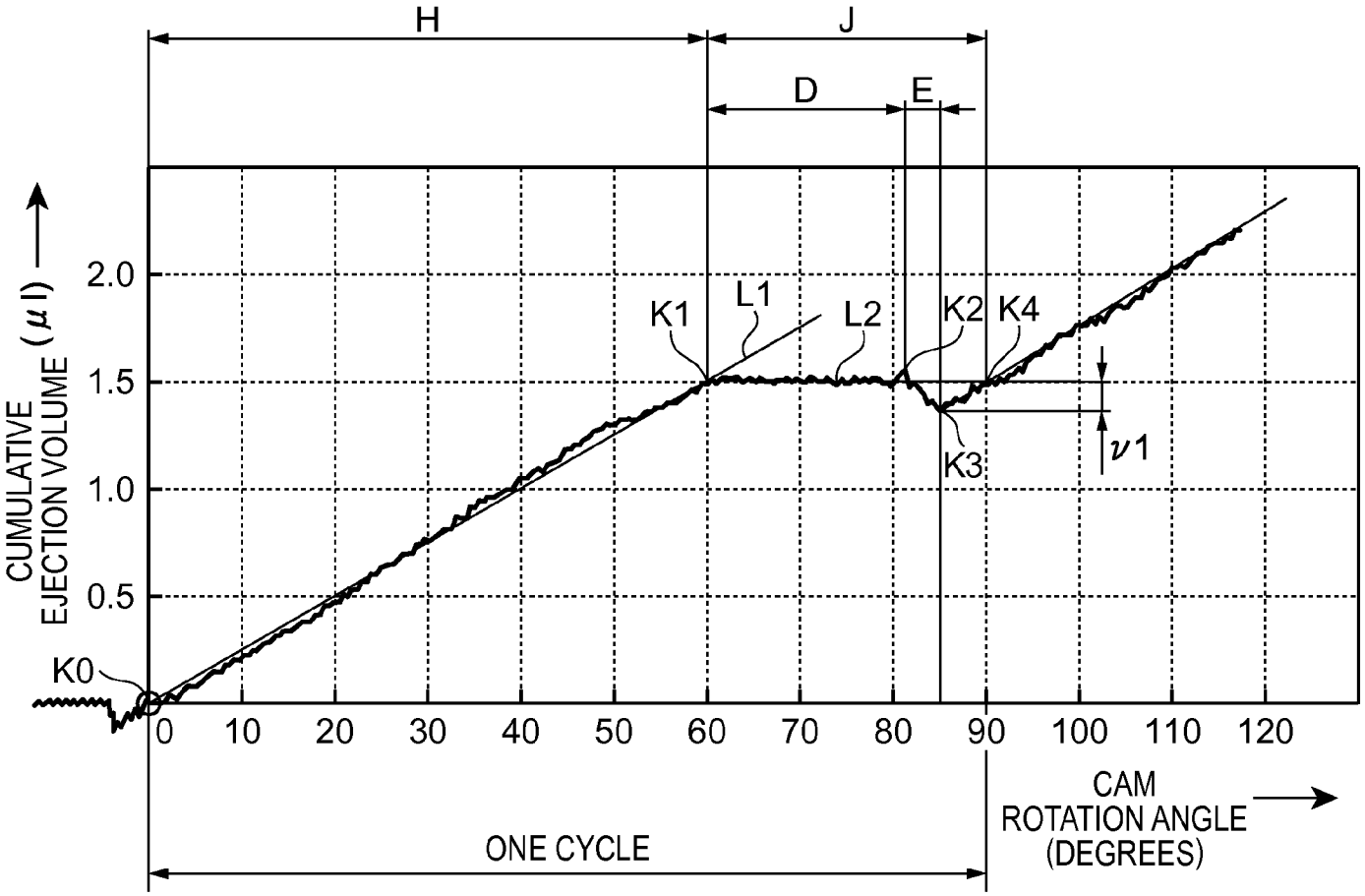
FIG. 6 is a graph showing the relation between cam rotation angle and cumulative ejection volume.

FIG. 6 is a graph showing the relation between the rotation angle of the cam and the cumulative ejection volume. The horizontal axis represents the rotation angle of the cam 20. The vertical axis represents the cumulative ejection volume (μl: micro liter). The graph refers to the case where the cam rotation speed is constant, and the rotation angle of the cam and the cumulative ejection volume show actual measured values for each fluid conveying device. A first approximation formula and a second approximation formula which will be described later are created based on this graph. Since the respective finger pushing parts have the same action, the action of the finger pushing part 22 will be described as an example. FIG. 4 is referred to as well.

As the cam 20 is rotated from a rotating position K0 (this position being a reference position 0) of the cam 20 where the first detection marker 30*a* is detected, the cumulative ejection volume increases substantially in proportion to the cam rotation angle. When the cam 20 is rotated 60 degrees (when a rotating position K1 is reached), the cumulative ejection volume is 1.5 μl. In an area from the rotating position K1 to a rotating position K2, the cumulative ejection volume does not increase or decrease and is substantially constant. This is an area where the finger 46 continues to pressurize and close the tube 50.

As the cam 20 is further rotated and reaches a rotating position over the rotating position K2, the engagement between the finger pushing part 22 and the finger 46 is canceled and the tube 50 is opened. Then, the cumulative ejection volume decreases by v1 from the rotating position K2 up to a rotating position K3. This example shows that 0.13 μl of the ejected liquid flows backward. This phenomenon occurs because when the engagement of the most downstream finger 46 with the finger pushing part 22 of the cam 20 is canceled to open the tube 50, the capacity part of the tube 50 that is previously pressurized and closed by the finger 46 now has a negative pressure and therefore sucks the liquid and generates a backflow. As the cam 20 is further rotated, the slope part 23*a* of the cam 20 pushes the most upstream finger 40 to pressurize and close the tube 50 and the liquid starts to be ejected. At a rotating position K4, the cumulative ejection volume 1.5 μl is reached with the ejection decrease compensated for.

Thus, the cumulative ejection volume can be expressed in terms of an ejection area H where the cumulative ejection volume increases substantially in proportion to the rotation angle of the cam 20 and a constant area J where there is little increase or decrease in the cumulative ejection volume even when the cam rotates. In the ejection area H, the relation between the cumulative ejection volume and the cam rotation angle is expressed by a first approximation line L1. In the constant area J, the relation can be expressed by a second approximation line L2. As shown in the graph of FIG. 6, actual measured values of the cumulative ejection volume may have minuscule increase or decrease. However, it is considered that this volume is 0.01 μl or smaller and therefore need not be taken into account.

Thus, if the cumulative ejection volume is v and the cam rotation angle is d, the first approximation line can be expressed as a linear equation $v=\alpha d+b$, which is referred to as a first approximation formula. The second approximation line can be expressed by a linear equation $v=\beta$, which is referred to as a second approximation formula. In this example, the gradient of the line α is 0.025 μl/degree (1.5 μl/60 degrees), b=0, and β is 1.5 μl.

This graph shows the action of one of the finger pushing parts of the cam 20. Since the four finger pushing parts are formed, the ejection area H and the constant area J are repeated four times during one turn of the cam 20. If the rotation speed of the cam 20 is constant, the first approximation formula and the second approximation formula for each finger pushing part can be created by a similar way of thinking. For example, when the protrusion 23 pressurizes and closes the tube 50, a linear equation with b in the first approximation formula modified to pass through the rotating position K4 and with a gradient α of 0.025 μl/degree may be employed, and β in the second approximation formula may be changed to 3.0.

Thus, the cam 20 can be rotated until a rotation angle that is required in relation to a designated cumulative ejection volume according to the first approximation formula and the second approximation formula is reached. This rotation angle is detected by the first detection unit and the second detection unit. Next, a specific driving method for the fluid conveying device 1 will be described with reference to FIG. 1 to FIG. 8.

Driving Method for Fluid Conveying Device

Example 1

Example 1 is the case where the graph of FIG. 6 showing the relation between the rotation angle of the cam 20 and the cumulative ejection volume is used as a basic form and the cam 20 is rotated at a constant speed.

Figure 7:
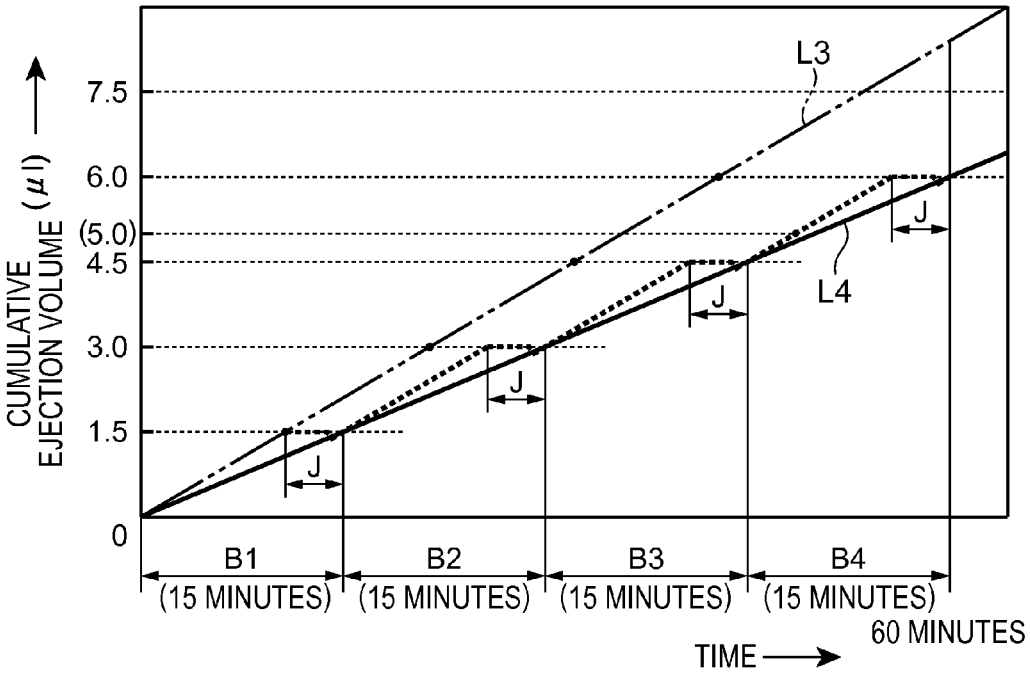
FIG. 7 is a graph showing the relation between cam driving time and cumulative ejection volume.

FIG. 7 is a graph showing the relation between the driving time of the cam and the cumulative ejection volume. The horizontal axis represents the driving time of the fluid conveying device 1. The vertical axis represents the cumulative ejection volume from the start of the driving.

Figure 8:
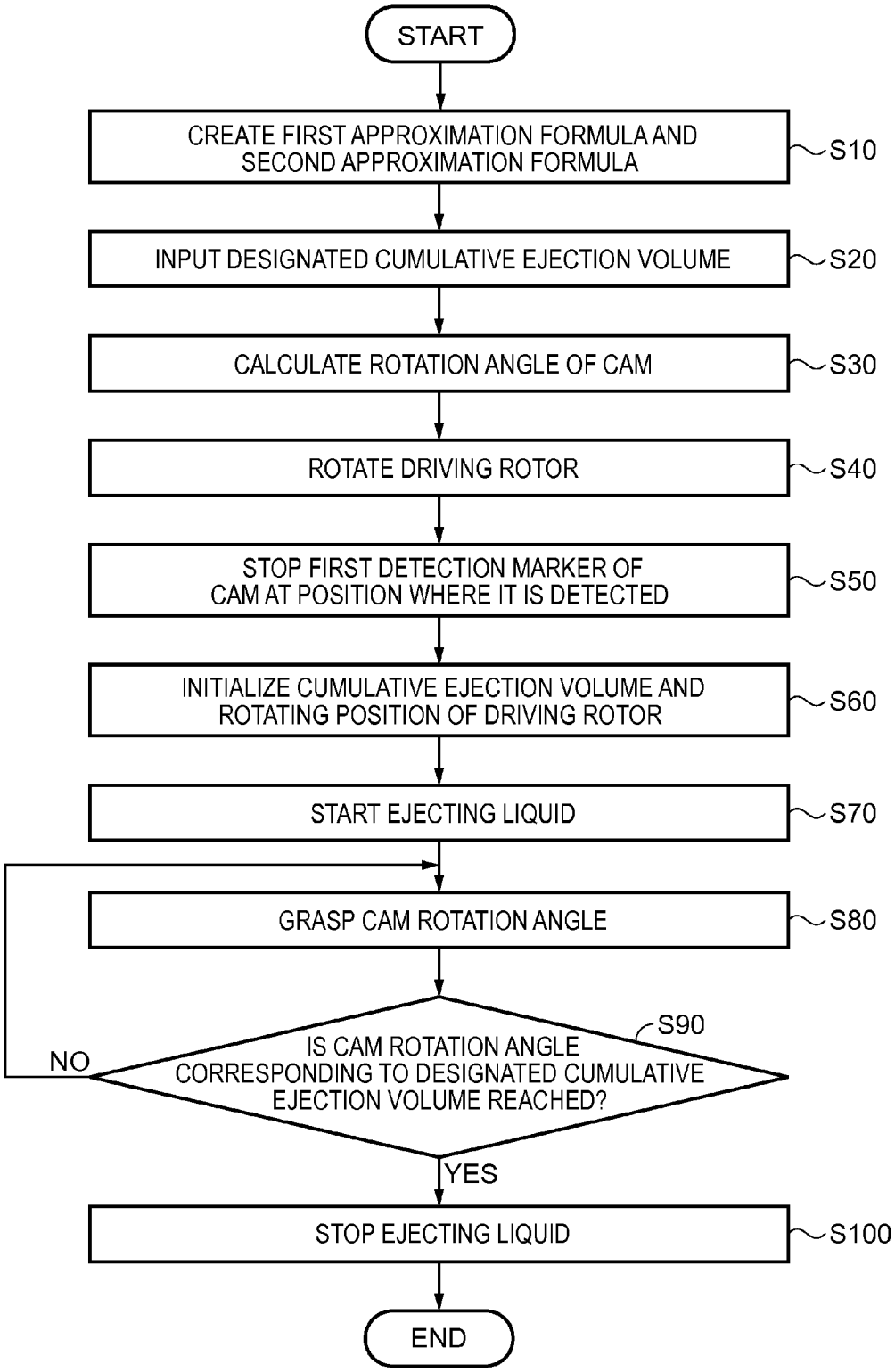
FIG. 8 is an explanatory view showing principal steps of a driving method for a fluid conveying device.

FIG. 8 is an explanatory view showing principal steps of the driving method for the fluid conveying device. In this example, the case where an ejection speed for ejecting 6.0 μl by rotating the cam 20 one turn in 60 minutes is provided is described as an example. This example is described along the steps shown in FIG. 8.

First, the relation between the cam rotation angle of the fluid conveying device 1 as a driving target and the cumulative ejection volume is actually measured in advance. The graph shown in FIG. 6 is created. The data of the graph is inputted to the control unit 140 (specifically, the storage unit 145). Based on this data, the arithmetic operation unit 146 creates the first approximation formula and the second approximate formula (step S10). In this example, since the four finger pushing parts are provided on the cam 20 and the cam rotation speed is constant, the relation between the rotation angle of the cam and the cumulative ejection volume can be expressed in FIG. 7 (indicated by a broken line). If the cumulative ejection volume in "an ejection area H+a constant area J" is defined as one ejection unit, the driving time of 60 minutes includes four ejection units (indicated by block B1, block B2, block B3 and block B4). Therefore, the duration of each block is 15 minutes.

In this example, the number of finger pushing parts is four. However, if the number of finger pushing parts is n (n being an integer equal to or greater than 2), the cumulative ejection volume to be ejected during 1/n turns is defined as one ejection unit.

Subsequently, a designated cumulative ejection volume is inputted, using an input device, not shown (step S20). Here, the designated cumulative ejection volume is provisionally assumed to be 5.0 μl.

Next, the arithmetic operation unit calculates a cam rotation angle corresponding to the designated cumulative ejection volume (step S30). To eject 5.0 μl, the cam 20 needs to be rotated by "three ejection units (three blocks)+a fractional angle" (see FIG. 7). Therefore, the rotation angle of the cam 20 is 270 degrees+the fractional angle. That is, the first detection unit detects the first detection markers 30 from the reference position (position K0) and the cam needs to be rotated additionally by the fractional angle.

The fractional angle is calculated using the first approximation formula and a rotation angle of the driving rotor 120 is found. Here, the fractional angle is equivalent to a cam rotation angle of 20 degrees following the detection of the third one of the first detection markers 30. If the deceleration ratio is 1/40, the rotation angle of the driving rotor 120 corresponding to the cam rotation angle is 20 degrees×40=800 degrees. This is equivalent to two turns and 80-degree rotation of the driving rotor 120. If the number of divisions of the second detection markers 25 provided on the driving rotor 120 is twelve, the driving rotor 120 can be rotated until three marks of the second detection markers 35 is detected following the detection of the third one of the first detection markers 30.

Since the cam rotation angle corresponding to the designated cumulative ejection volume 5.0 μl is 290 degrees, the rotation angle of the driving rotor 120 corresponding to the 290 degrees may also be calculated as 32 turns and rotation by three marks of the second detection markers 35.

Next, the driving rotor 120 is rotated (step S40). At a position where the first detection marker 30 on the cam 20 is detected, the driving rotor is stopped (step S50). At this point, the rotating position of the driving rotor 120 is stored as a detected position of the second detection marker 35 together with the reference position of the cam 20, and the cumulative ejection volume and the rotating positions of the driving rotor 120 and the cam 20 are initialized (step S60).

Next, the driving rotor 120 is driven to start eject the liquid, and the cam 20 is rotated by an amount corresponding to the designated cumulative ejection volume (step S70).

During the ejection of the liquid, the cam rotation angle is grasped (step S80). Specifically, the number of detections of the first detection markers 30 on the cam 20 and the number of detections of the second detection markers 35 on the driving rotor 120 are counted by the counter 144 and the results are inputted to the storage unit 145.

Then, whether the cam rotation angle corresponding to the designated cumulative ejection volume is reached is determined by compassion with the stored designated rotation angle (step S90). If the designated cam rotation angle is reached (step S90, YES), the driving rotor 120 is stopped and the rotation of the cam 20 is stopped, thus stopping the ejection of the liquid (step S100). If the designated cam rotation angle is not reached yet (step S90, NO), the driving of the driving rotor 120 is continued and the step S80 and the subsequent steps are continued.

Driving Method for Fluid Conveying Device

Example 2

Next, Example 2 will be described. While the above Example 1 is a driving method in the case where the cam 20 is rotated at a constant speed, Example 2 is a driving method in the case where the rotation speed in the constant area J is higher than the rotation speed in the ejection area H. This example will be described with reference to FIG. 7 and FIG. 8. In step S10, the first approximation formula and the second approximation formula are created based on actual measured values, as in Example 1. However, in the constant area J (see FIG. 6), the cam rotation speed is higher, for example, approximately 10 to 20 times higher than in the ejection area H. Therefore, the time in the constant area J is very short. As shown in FIG. 7, a straight line (indicated as line L3) can be formed on an extended line of the first approximation line L1. However, this cannot satisfy the designated ejection speed of 6.0 μl in 60 minutes.

Thus, to satisfy the designated ejection speed of 6.0 μl in 60 minutes, the gradient of the line L3 is corrected (the cam rotation speed in the ejection area H is slowed down) to create a line L4, which is used as a reference line.

Next, a designated cumulative ejection volume is inputted (step S20). The designated cumulative ejection volume is provisionally assumed to be 5.0 μl. Next, the arithmetic operation unit calculates a cam rotation angle corresponding to the designated cumulative ejection volume (step S30).

Here, the cam rotation angle corresponding to the designated cumulative ejection volume is calculated based on the reference line L4. In this case, to calculated the cam rotation angle, the number of blocks is found where the cumulative ejection volume during the rotation by one mark of the first detection markers 30 on the cam 20 is defined as one ejection unit (one block), and since a fractional angle corresponds to the ejection area, the fractional angle is calculated as a rotation angle of the driving rotor 120 using the first approximation formula. Since the first approximation formula corresponds to the ejection area H of FIG. 6, the rotation angle of the driving rotor 120 can be calculated similarly to Example 1. Step S40 and the subsequent steps can be carried out similarly to Example 1 and therefore will not be described further in detail.

The cam rotation angle in the ejection area H may be adjusted to lie on the reference line L4 so that the designated ejection speed becomes substantially constant.

As in JP-A-2004-92537 described above, with the method in which the rotation angle of the rotor is finely divided, then, the ejection volume in each division is measured and stored and the sum of the ejection volumes at each angle is calculated every time the rotation of the rotor proceeds, access to the memory is frequently needed in order to readout the data table and therefore reduction in current consumed is difficult. However, with to the configuration of the fluid conveying device 1 and the driving method according to this example, the cam rotation angle in relation to the cumulative ejection volume is calculated using the two approximation formulas with different ejection speeds (first approximation formula and second approximation formula), and the cam 20 is rotated until the designated cumulative ejection volume is reached. Therefore, compared with the related art, the configuration of the control unit 140 can be simplified and the load on the control unit 140 can be reduced, for example, by reducing the number of calculations. Consequently, there is an advantage that the current consumed can be reduced.

Moreover, by using the approximation formulae, it is possible to eliminate the influence of fluctuation in the ejection volume during the rotation of the cam 20 or per turn of the cam 20 and to grasp a more accurate total ejection volume.

In the constant area J, the cam rotation speed is made higher than in the cam rotation speed in the ejection area H. Therefore, the cumulative ejection volume in relation to the cam rotation angle can be expressed substantially by a straight line and the fluid can be continuously ejected at a constant ejection speed in an ejection designated time.

In Example 2, the relation between the rotation angle of the cam (cam driving time) and the cumulative ejection volume of the fluid is linearized to create a reference line, and the number of ejection units is calculated based on the reference line, where the cumulative ejection volume ejected during 1/4 turns of the cam 20 is defined as one ejection unit. The rotation angle of the cam 20 corresponding to the difference between the designated cumulative ejection volume and the cumulative ejection volume equivalent to the number of ejection units is calculated using the first approximation formula. Thus, as the cam rotation speed is higher in the constant area where the fluid is not ejected, the cumulative ejection volume in relation to the cam rotation angle can be expressed substantially by a straight line. This straight line is defined as the reference line L4 and the calculation uses the reference line L4 and the above approximation formulae. Thus, the rotation angle of the cam 20 in relation to the designated cumulative ejection volume can be found easily.

In Example 1 and Example 2 described above, the case where the first approximation line L1 is a straight line is described as an example. However, approximation can be carried out using a monotone increasing function by which the rotation angle of the cam 20 is defined from the cumulative ejection volume.

Thus, the relation between the cumulative ejection volume and the cam rotation angle is not limited to a straight line in the ejection area, and even a quadratic curve or parabola can be used as the first approximation formula.

The entire disclosure of Japanese Patent Application No. 2010-274319, filed Dec. 9, 2010 is expressly incorporated by reference herein.

What is claimed is:

1. A fluid conveying device which ejects a fluid, the device comprising:

an elastic tube;

a cam having n (n being an integer equal to or greater than 2) protrusions;

plural pressing shafts arranged along the tube between the tube and the cam;

a driving unit which rotates the cam to sequentially push the plural pressing shafts by the protrusions in a flowing direction of the fluid, and thus repeats pressurized closure and opening of the tube;

a detection unit which detects a rotating position of the cam; and a control unit which calculates a cam rotation angle in relation to a cumulative ejection volume, using only two approximation formulae, a first approximation formula of the two approximation formulae expresses an ejection area where the cumulative ejection volume increases in proportion to the rotation angle of the cam and a second approximation formula that expresses a constant area where the cumulative ejection volume does not increase or decrease even if the cam rotates, and which drives the driving unit until the detection unit detects a rotating position of the cam corresponding to a designated cumulative ejection volume, wherein during a cam rotation cycle, the cumulative ejection volume increases in the ejection area as the cam rotates during approximately two-thirds of the rotation cycle and wherein the cumulative ejection volume does not increase or decrease in the constant area as the cam rotates during approximately one-third of the rotation cycle, wherein the constant area includes a first area where the cumulative ejection volume is substantially constant, a second area where the cumulative ejection volume decreases, and a third area where the cumulative ejection volume increases, the decrease in the second area being approximately equal to the increase in the third area.

2. The fluid conveying device according to claim 1, wherein in the constant area, a rotation speed of the cam is made higher than a rotation speed of the cam in the ejection area.

3. The fluid conveying device according to claim 1, wherein a reference line expressing a relation between the rotation angle of the cam and the cumulative ejection volume of the fluid is created, the cumulative ejection volume ejected during 1/n turns of the cam is defined as one ejection unit, and a number of ejection units is calculated based on the reference line, and the rotation angle of the cam in relation to a cumulative ejection volume corresponding to a difference between the designated cumulative ejection volume and a cumulative ejection volume equivalent to the number of ejection units is calculated, using the first approximation formula and the second approximation formula.

4. The fluid conveying device according to claim 1, wherein the first approximation formula performs approximation using a monotone increasing function by which the rotation angle of the cam is defined from the cumulative ejection volume.

5. A driving method for a fluid conveying device which ejects a fluid, the method comprising:

rotating a cam having n (n being an integer equal to or greater than 2) protrusions;

stopping the rotation of the cam when a rotation angle of the cam is detected;

initializing a cumulative ejection volume and the rotation angle of the cam;

calculating a rotation angle of the cam corresponding to a designated cumulative ejection volume, using only two approximation formulae, a first approximation formula of the two approximation formulae expresses an ejection area where the cumulative ejection volume increases in proportion to the rotation angle of the cam and a second approximation formula that expresses a constant area where the cumulative ejection volume does not increase or decrease even if the cam rotates;

starting fluid ejection by rotating the cam to sequentially push plural pressing shafts in a flowing direction of the fluid by the protrusions and thus repeating pressurized closure and opening of an elastic tube; and detecting the rotation angle of the cam, and stopping the rotation of the cam when the rotation angle corresponding to the designated cumulative ejection volume is reached, wherein during a cam rotation cycle, the cumulative ejection volume increases in an ejection area as the cam rotates during approximately two-thirds of the rotation cycle and wherein the cumulative ejection volume does not increase or decrease in a constant area as the cam rotates during approximately one-third of the rotation cycle, wherein the constant area includes a first area where the cumulative ejection volume is substantially constant, a second area where the cumulative ejection volume decreases, and a third area where the cumulative ejection volume increases, the decrease in the second area being approximately equal to the increase in the third area.

6. A fluid conveying device which ejects a fluid, the device comprising:

an elastic tube;

a cam having n (n being an integer equal to or greater than 2) protrusions;

plural pressing shafts arranged along the tube between the tube and the cam;

a driving unit which rotates the cam to sequentially push the plural pressing shafts by the protrusions in a flowing direction of the fluid, and thus repeats pressurized closure and opening of the tube;

a detection unit which detects a rotating position of the cam; and a control unit which calculates a cam rotation angle in relation to a cumulative ejection volume, using two approximation formulae, a first approximation formula of the two approximation formulae expresses an ejection area where the cumulative ejection volume increases in proportion to the rotation angle of the cam and a second approximation formula that expresses a constant area where the cumulative ejection volume is substantially constant over a first region, decreases over a second region, and is compensated for the decrease over a third region, and which drives the driving unit until the detection unit detects a rotating position of the cam corresponding to a designated cumulative ejection volume, wherein during a cam rotation cycle, the cumulative ejection volume increases in the ejection area as the cam rotates during approximately two-thirds of the rotation cycle and wherein the cumulative ejection volume does not increase or decrease in the constant area as the cam rotates during approximately one-third of the rotation cycle, wherein the constant area includes the first region where the cumulative ejection volume is substantially constant, the second region where the cumulative ejection volume decreases, and the third region where the cumulative ejection volume increases, the decrease in the second region being approximately equal to the increase in the third region.

* * * * *